US005140814A

United States Patent [19]

Kreutmair et al.

[11] Patent Number: 5,140,814

[45] Date of Patent: Aug. 25, 1992

[54] EXHAUST GAS SYSTEM WITH AN PARTICULATE FILTER AND A REGENERATING BURNER

[75] Inventors: Josef Kreutmair, Ehrenberg; Nikolaus König, Günzlhofen; Alfred Zöbl, Munich; David M. Simpkin, Günding, all of Fed. Rep. of Germany

[73] Assignee: MAN Technologie AG, Munich, Fed. Rep. of Germany

[21] Appl. No.: 639,597

[22] Filed: Jan. 9, 1991

[30] Foreign Application Priority Data

Jan. 25, 1990 [DE] Fed. Rep. of Germany ..... 4002130
Mar. 22, 1990 [DE] Fed. Rep. of Germany ..... 4009201

[51] Int. Cl.[5] ..... F01N 3/02
[52] U.S. Cl. ..... 60/303; 55/466; 55/DIG. 30
[58] Field of Search ..... 60/286, 303; 55/466, 55/DIG. 30

[56] References Cited

U.S. PATENT DOCUMENTS

| | | | |
|---|---|---|---|
| 4,033,123 | 7/1977 | Masaki | 60/286 |
| 4,459,805 | 7/1984 | Kamiya | 60/303 |
| 4,651,524 | 3/1987 | Brighton | 60/286 |
| 4,858,432 | 8/1989 | Knauer | 60/303 |

FOREIGN PATENT DOCUMENTS

| | | | |
|---|---|---|---|
| 29718 | 2/1984 | Japan | 60/303 |

*Primary Examiner*—Douglas Hart
*Attorney, Agent, or Firm*—Ladas & Parry

[57] ABSTRACT

An exhaust gas system with a particulate filter and a regenerating burner, whose hot gas outlet is provided in the vicinity of a closed end of the filter in the form of a plurality of openings, which are arranged in one or more planes parallel to the entry surface of the particulate filter. Due to the splitting up of the hot gas flow in the burner into a plurality of smaller flows of hot gas, the mixing with the exhaust gas is so improved that directly downstream from the flame tube of the burner there is a substantially complete equalization of temperature whereby the particulate filter may be positioned very close to the burner.

15 Claims, 4 Drawing Sheets

EXHAUST GAS SYSTEM WITH AN PARTICULATE FILTER AND A REGENERATING BURNER

BACKGROUND OF THE INVENTION

The invention relates to a exhaust gas system with a particulate filter and a burner for regeneration of the particulate filter, the burner being equipped with a fuel mixing nozzle and with a flame tube extending at least in part into the exhaust gas system and being able to be acted upon by the exhaust gas.

In so-called full flow burner exhaust gas systems, the burner is so positioned in the exhaust gas tube that the exhaust gas flows partly around the burner and at the outlet of the burner is mixed with the hot gases. The advantage of this design is that the burner may be lit even during operation of the engine in which exhaust gases are being expelled. A system of this type is described in the European patent publication 306 743A2, in which the exhaust gases flow in an annular gap perpendicularly onto a flame tube of the burner, sweep along the flame tube in the longitudinal direction and the finally in a transverse flow mixer are mixed with the hot gases coming from the burner. For this purpose there is a hot gas outlet opening at the end face of the flame tube and there is a baffle plate positioned at a distance from this opening and opposite to it, such means deflecting the axially merging hot gases radially, before they are mixed with the exhaust gases.

In the case of such a design it is possible for unfavorable flow conditions to arise in which the hot gases which come from the radial outlet ring formed between the baffle plate and the end wall of the flame tube, are not evenly distributed, so that local, overheated currents may cause damage to the filter. In this respect it is possible furthermore for unburned fuel from the burner to be ignited at the radial outlet and to burn with the residual oxygen, contained in the exhaust gas, as s secondary flame, which has a larger size, that is to say a large flame length and may also cause local damage to the soot filter positioned relatively close to the burner. In such cases the particulate filter has to be placed at a considerable distance from the burner for safety reasons, this increasing the overall size and making the system more expensive.

SHORT SUMMARY OF THE PRESENT INVENTION

Accordingly one object of the present invention is to provide an exhaust gas system of the type initially mentioned such that there is no danger of overheating of a filter positioned adjacent to the burner.

In order to achieve this and/or other aims the flame tube is provided with a plurality of hot gas outlet openings, which are placed in at least one plane, which is positioned so as to be essentially plane-parallel to the entry surface of the filter.

It is in this manner that the hot gas is divided upon into a plurality of relatively small hot gas currents by the hot gas outlet openings in the flame tube. This offers the advantage that an even and complete mixing of the exhaust gas and the hot gas is possible and furthermore the danger of the creation of major flames is avoided. The intimate mixing of the exhaust gases means that even at the point of mixing a mixed gas is produced which has a substantially equal temperature. Therefore is it possible to provide a filter for suspended particles or, respectively, soot at a position very near the burner and thus to fully profit from the advantages thereof.

The hot gas outlet openings are preferably evenly distributed over the flame tube and in relation to its diameter are so far apart that the emerging hot gas currents do not as far as possible come into contact with each other. The diameter is as small as possible and the number of the outlet openings is made as large as possible, the lower and, respectively, the upper limit being determined in accordance with the specific application in a manner dependent of the necessary pressure and flow conditions.

The flame tube provided with a plurality of outlet openings may be positioned in various ways in the flow path of the exhaust gas and preferably an arrangement is selected in which the exhaust gas flows around the flame tube to cool it and finally impinges tranversely on the outlet openings for the hot gas. In order to intensify the mixing operation it is possible in accordance with the invention for the arrangement to be so selected that the exhaust gas impinges tangentially on the flame tube and flows around it in a swirling spiral and flows into the hot gas currents.

In accordance with a further advantageous feature of the invention the hot gas outlet openings are distributed on one or more transverse planes near the end of the flame tube with an even spacing, the end of the flame tube being closed. In this case the hot gas impinges in the form of a plurality of radial flows coming from the flame tube, it being in one plane, which runs parallel to the inlet face of the filter.

The above noted forms of the invention have the advantage of a symmetrical distribution of the hot gas, which favors an equalization of the hot gas temperature upstream from the filter. As a rule the position of the outlet openings for the hot gas in the flame tube will be dependent on the respective design concept for the exhaust gas system. In the case of a burner tube set tranversely to the filter, for instance, the outlet openings are provided on two diametrically opposite axis-parallel lines on the outer face of the flame tube and on the diameter connecting such lines on the end surface of the flame tube.

As part of a further advantageous feature of the present invention it is possible for the mixing of the hot gases to be further optimized if a spin plate is provided on the flow path of the exhaust gas or of the gas mixture. The spin plate may have a plurality of slots with intermediate and slightly skew, sheet metal elements. When flow takes place through the slots the gas which has already been mixed, or the exhaust gas is split up into a plurality of swirling gas flows so that there is more intimate mixing of the exhaust gas and of the hot gas even in a very short distance. The spin plate is preferably positioned just short of the outlet of the hot gas, in the direction of flow, from the flame tube so that following the detachment edge on the spin plate part of the flow may entrain part of the hot gas flow in its vortex motion.

The spin plate may simultaneously serve to concentrate or to fan out the exhaust gas flow so that the configuration of the flame may be adapted to the form of the filter housing.

This system is furthermore favored by the use of a conventional blue flame burner which may be designed with different performances, for instance in accordance with the exhaust gas temperature of the engine. It is in this manner that it is possible to ensure that in the low load range of the engine it is possible to provide substoichiometric operation of the burner, more particularly because in the case of a blue flame burner the emission noxious substances and of unburned fuel are low and in an amount which may be readily burnt later with the residual oxygen in the exhaust gas.

There are applications, in the case of which a splitting of the exhaust gas flow into two flows presents an advantage, one part of the flow being caused to flow through the flame tube. This is readily possible in the case of the arrangement in accordance with the invention and it is an advantage in the case of there being a shortage of space.

Further features and advantages of the invention will be gathered from the ensuing detailed description of several embodiments thereof referring to the drawings.

LIST OF THE SEVERAL VIEWS OF THE DRAWINGS

FIG. 6 and

Figure 7:
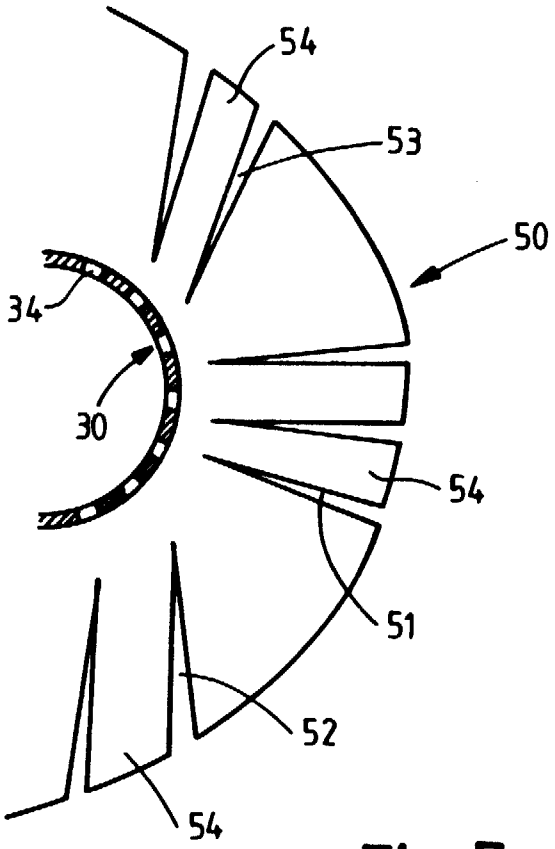

FIG. 7 respectively show further working embodiment.

DETAILED DESCRIPTION OF WORKING EMBODIMENTS OF THE INVENTION

Figure 1:
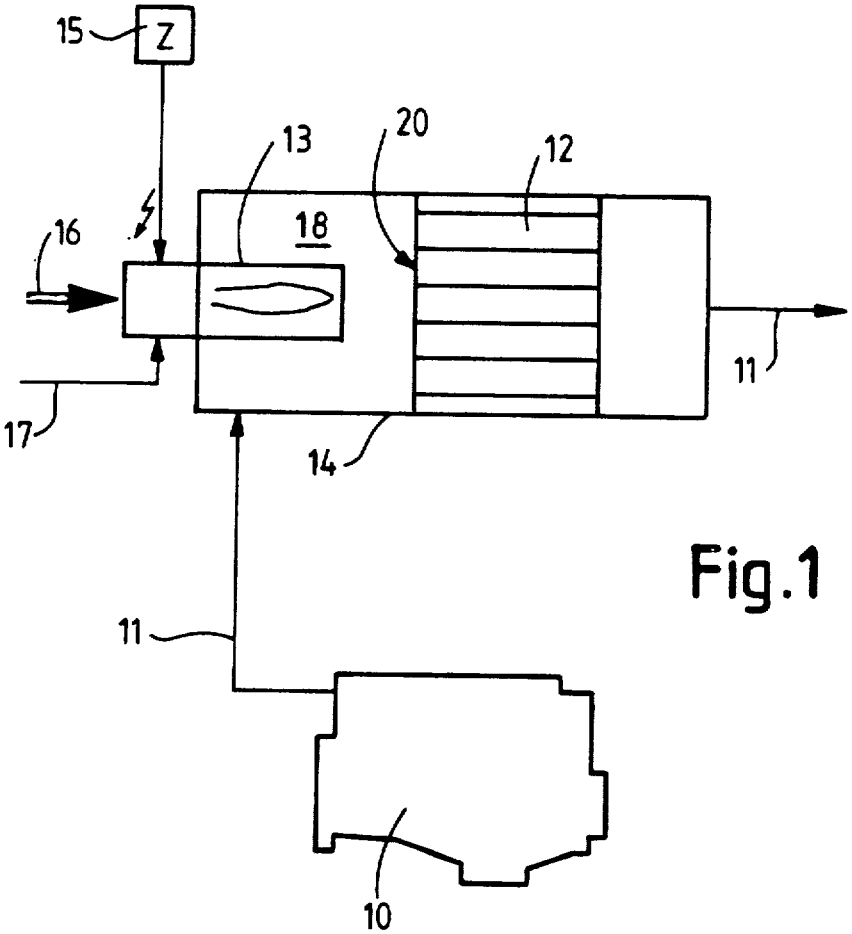
FIG. 1 shows an exhaust gas system.

FIG. 1 shows an IC engine 10, in whose exhaust gas pipe 11 a particulate filter 12 and a burner are positioned between the ends thereof. The exhaust gas emerging from the IC engine 10 passes into a housing 14, in which the burner 13 and the filter 12 are placed consecutively in the direction of flow. As a rule the burner 13 will be out of operation when the engine 10 is running so that the soot particles from the exhaust gas will collect in the filter 12. In accordance with criteria, which are different from case to case, the burner 13 will be put into operation by ignition by means of a spark gap 15 and the supply of fuel 16 and combustion air 17. The hot gas emerging the burner 13 are mixed in the antechamber 18 of the filter 12 with the exhaust gas with an increase in temperature to such an extent that the soot particles collected in the filter 12 are oxidized.

The overall size, for instance of the housing, is dependent inter alia on the distance, which has to be allowed, between the burner 13 and the filter 12. As a rule this distance will be made fairly large in order to avoid local overheating at the inlet of the filter 12, which might be due to irregular mixing of the exhaust gas and the hot gas and, furthermore, to secondary flames in the antechamber 18.

In order to provide a remedy in this respect a burner 13 is provided, whose hot gas does not emerge through one single opening but rather through a plurality thereof in the flame tube, such openings being positioned in one plane, which runs parallel to the inlet surface 20 of the filter 12. This may be ensured in a number of different ways dependent on the alignment of the burner 13 in relation to inlet surface 20 of the filter 12.

Figure 2:
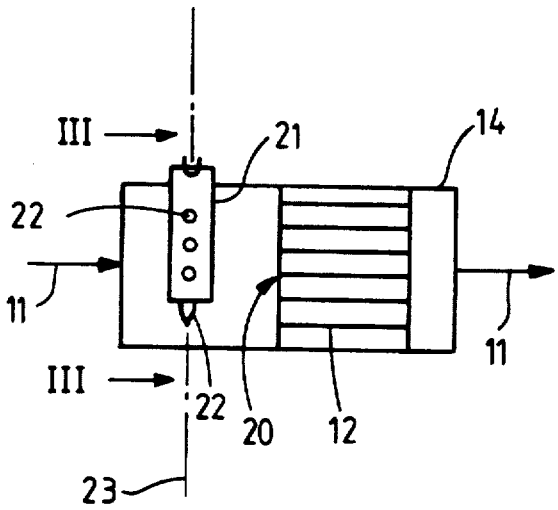
FIG. 2 shows a first working embodiment of the invention.
Figure 3:
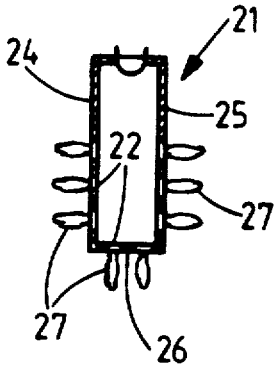
FIG. 3 is a detailed view of part of the arrangement of FIG. 2.

A design like that of FIG. 2 is possible in which the flame tube 21 would be parallel to the inlet surface 20 of the filter 12. In this case the hot gas outlet openings 22 are on a plane 23, which is defined by two diametrically opposite axis-parallel lines 24 and 25 on the outer face of the flame tube 21 and a line connecting the two lines on the end face 26 of the flame tube burner. The plane 23 is furthermore so selected that it is parallel to the inlet surface 20 of the filter 12. This longitudinal section plane is indicated in FIG. 3 with the emerging hot gas flows 27. The exhaust gas flow 11 entering the housing 14 surrounding the burner 21 and the filter 12 meets with the hot gas flows 27 perpendicularly and mixes with them in a substantially homogeneous manner owing to the division of the hot gas.

The splitting up of the hot gas into a plurality of small flows is preferably caused to take place in conjunction with a flame tube, which is positioned perpendicularly to the entry plane 20 of the filter 12. This arrangement is illustrated in FIG. 1.

Figure 4:
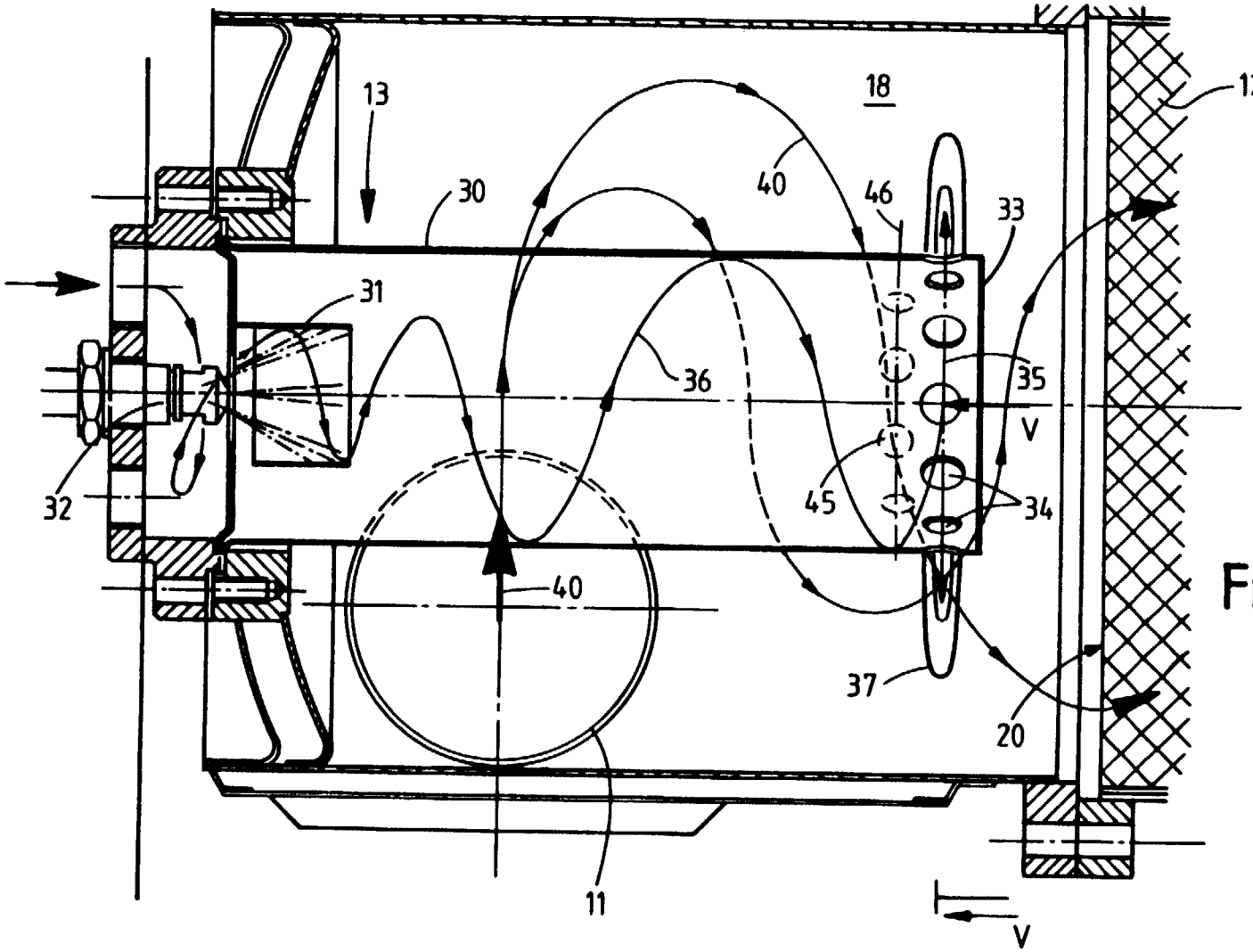
FIG. 4 shows a second working embodiment.
Figure 5:
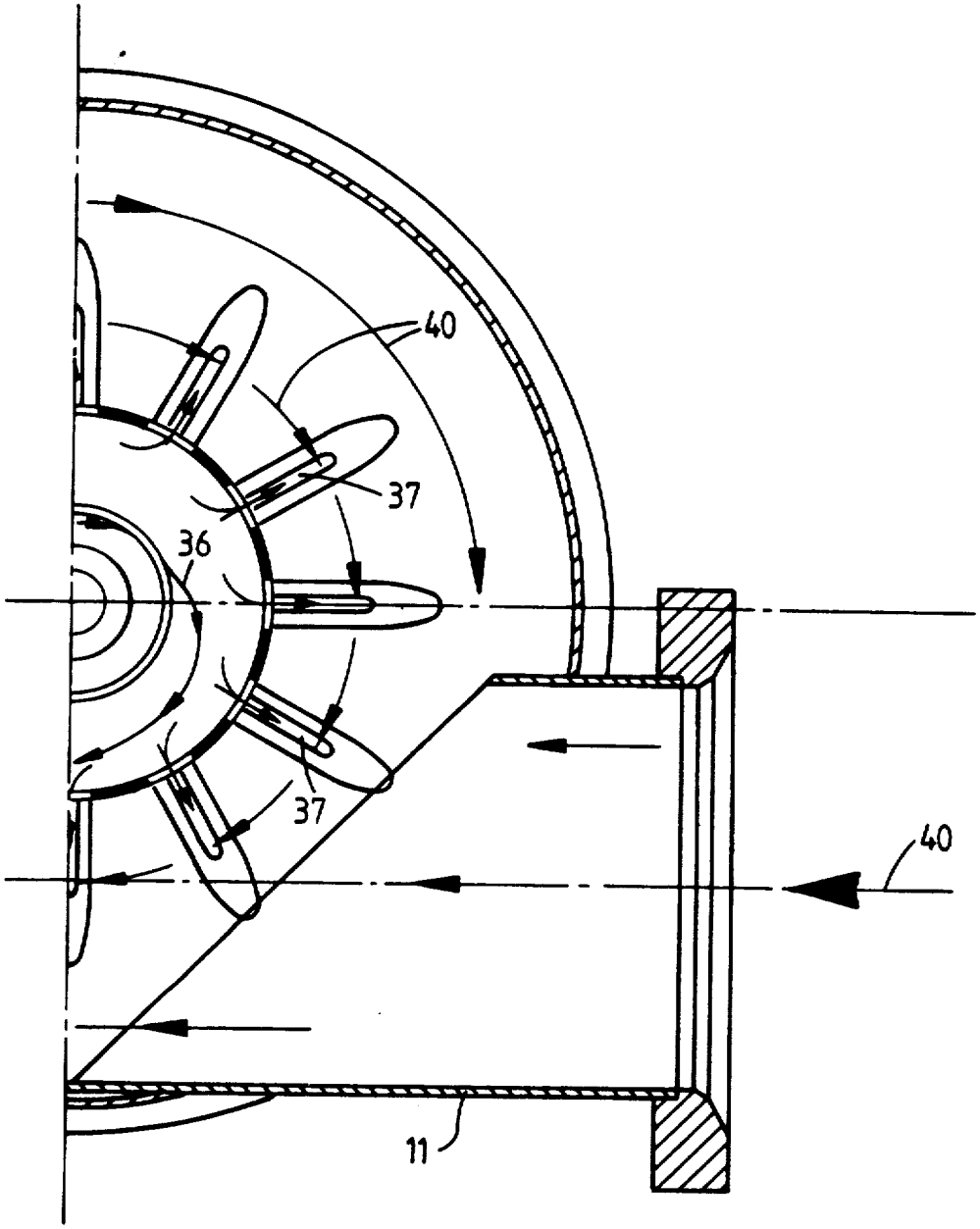
FIG. 5 shows one half of a cross section taken through the arrangement of FIG. 4.

The working embodiment of this idea is illustrated in FIG. 4. The burner 13 consists of a flame tube 30, a mixing tube 31 and an atomizing nozzle 32. The end face 33, positioned opposite to the atomizing nozzle 32, of the flame tube 30 is closed on all sides. Near this end the flame tube 30 has evenly distributed outlet openings 30 on the circumferential extent, which are located in a plane 35, which is parallel to the inlet plane 20 of the filter. As is illustrated in FIG. 5 by the section taken on the line V—V, the hot gas 36 emerges in a stellate configuration as a plurality of flow parts 37 from the flame tube 30, that is to say parallel to the entry surface 20 of the filter 12. As shown in FIG. 5 in more detail, the exhaust gas 40 flows tangentially into the antechamber 18, in which the flame tube 30 is located and flows with a spiral motion around the tube 30. At the end of the flame tube 30 the exhaust gas 40 meets the hot gas flows 37 perpendicularly, the two gases being practically completely mixed with each other along an extremely short distance. Even at only a short axial distance from the flame tube 30 there will be an essentially equalized temperature in the antechamber 18. Therefore it is possible to position the filter 12 very close to the end face 33 of the burner 13.

The design in accordance with FIG. 4 offers the advantage over that in accordance with FIG. 2 that the hot gas 30 emerging from the outlet openings 34 located at the end of the flame tube 30 is more satisfactorily combusted. In this respect it is possible to have further rows of outlet openings for the hot gas 36, which are located in one or more planes parallel to the first plane 35. As shown in FIG. 4 there is further plane 46 with outlet openings 45 marked in broken lines. The outlet openings 34 of the first plane 35 are set so that they are opposite to spaces between openings in adjacent planes.

The connection of the hot gas emergence array with a so-called blue flame burner with or without a mixer tube 31 and/or a hot gas recycling system offers the further advantage that owing to the relatively satisfactory combustion in an extensive operational range of the blue flame burner an exhaust gas system with a variable burning rate becomes possible. The combustion rate is adapted to the engine exhaust gas temperature, this rendering possible a design leading to savings in fuel and optimum regulation of the entry temperature of the exhaust gas into the filter. Owing to the splitting up into a plurality of small hot gas flows 37 it is possible to achieve not only an equalization of the gas temperature but also a reduction of the length of the secondary flame during post-combustion of the unburned components, which are more particularly to be met with during substoichiometric operation of the burner. Owing to the splitting of the hot gas 36 it is then only possible for there to be small lengths of flame owing to the small amount of hot gas. Therefore for this reason as well any danger of local scorching of the filter surface or, respectively, uneven flame cleaning of the particulate filter is avoided.

Figure 6:
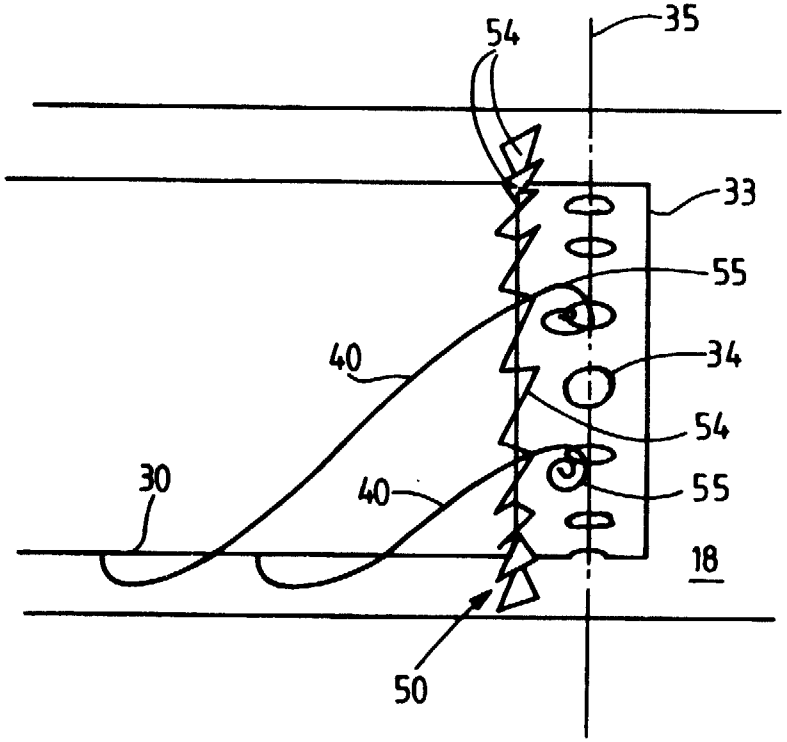

FIG. 6 shows a working embodiment of the invention, in which upstream from the hot gas outlet openings 34, in the direction of the exhaust gas 40, there is a spin plate 50 arranged parallel to the plane of the outlet openings 34. The spin plate 50, which is partly illustrated in FIG. 7 in plan, consists of a circular disk, which is slipped over the flame tube 30 and is permanently connected with the housing or with the flame tube and has a plurality of radial slots 51 through 53. The lamellae 54 formed by the slots 51 through 53 are set so as to be slightly skew about radial axes. The arriving exhaust gas 40 is split up by the spin plate 50 into a large number of flows, which downstream from the spin plate 50 form individual vortices 55. The arrangement of the spin plate 50 and of the outlet openings 34 for the hot gas is preferably such that each gas vortex 55 is swirled into a hot gas current so that even at the hot gas outlet 34 a significant mixing of the two gases takes place.

The lamellae acting as deflecting sheet metal elements, of the spin plate 50 may furthermore have such an alignment that they not only cause swirling of the flow parts but also, as may be necessary, cause deflection and change in direction for instance towards the axis of the burner, that is to say concentrating the exhaust gas flow or, as an opposite effect, causing the flow to flare or fan outwards.

The slots of the spin plate 50 may extend radially, as is marked by reference 51 in FIG. 7, or in order to increase the flow cross section at the spin plate 50 may be made more (52) or less (53) oblique. The spin plate 50 contributes to shortening the mixing path between the exhaust gas and the hot gas and therefore makes possible a further reduction of the distance between the burner 13 and the filter 12.

If the spin plate 50 should cause undue back pressure in the exhaust gas flow, it is possible to cause part of the flow, as a rule the smaller flow part 11' (FIG. 1), to move into the burner 13 in which the residual oxygen of the exhaust gas may be simultaneously utilized.

We claim:

1. An exhaust gas system comprising a housing, a particulate filter in said housing, means for introducing exhaust gas into the housing for flow to the particulate filter, a burner in said housing facing said particulate filter for regenerating the filter, said burner including a fuel nozzle for producing hot gas and a flame tube surrounding said nozzle and projecting therefrom towards said filter, said flame tube having a closed end facing said filter and a plurality of outlet openings for escape of hot gas, said outlet openings being disposed in a plane parallel to an entry surface of said filter so that the hot gas exists from said flame tube solely through said outlet openings and mixes with the exhaust gas in said housing, to flow therewith to said entry surface of the filter.

2. The exhaust gas system as claimed in claim 1, wherein the hot gas outlet openings are distributed at equal spacing around the flame tube.

3. The exhaust gas system as claimed in claim 1, wherein in the vicinity of the burner the exhaust gas system further comprises means for producing a transverse mixing effect between the exhaust gas and the hot gas emerging from the outlet openings.

4. The exhaust gas system as claimed in claim 1, wherein the particulate filter is positioned in the direction of flow of the exhaust gas directly downstream from the burner.

5. The exhaust gas system as claimed in claim 1, wherein said burner includes, add a mixing tube.

6. The exhaust gas system as claimed in claim 1, comprising a fuel and combustion air regulating means associated with the burner for controlling the burner in a manner dependent on engine load.

7. The exhaust gas system as claimed in claim 1, comprising a spin plate positioned in said housing to split up the said gas flow into a plurality of swirling flow.

8. The exhaust gas system as claimed in claim 7, wherein the spin plate is positioned on the flame tube directly upstream from the outlet openings for the hot gas.

9. The exhaust gas system as claimed in claim 7, wherein said spin plate has a configuration to adapt the outline of the flame to the shape of the housing.

10. The exhaust gas system as claimed in claim 1, wherein said closed end of the flame tube is opposite said nozzle and said outlet openings are proximate said closed end to discharge the hot gas substantially radially from the flame tube.

11. The exhaust gas system as claimed in claim 10, wherein the hot gas outlet openings are distributed at equal spacing said plane over the circumferential extent of the flame tube.

12. The exhaust gas system as claimed in claim 11, wherein further hot gas outlet openings are provided in said flame tube in a second plane.

13. The exhaust gas system as claimed in claim 10, wherein the flame tube and said means for introducing the exhaust gas into the housing are arranged to direct the exhaust gas spirally about the flame tube.

14. The exhaust gas system as claimed in claim 1, wherein the exhaust gas is caused to flow by said means which introduces the exhaust gas into the housing along a path which intersects the flow of the hot gas exiting from said outlet openings substantially at right angles.

15. The exhaust gas system as claimed in claim 1, wherein said closed end of said burner tube directly faces said entry surface of said particulate filter.

* * * * *